US006723685B2

(12) United States Patent
Hartley et al.

(10) Patent No.: US 6,723,685 B2
(45) Date of Patent: Apr. 20, 2004

(54) LUBRICATING OIL COMPOSITION

(75) Inventors: Rolfe J. Hartley, Cranbury, NJ (US); Malcolm Waddoups, Westfield, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/117,679

(22) Filed: Apr. 5, 2002

(65) Prior Publication Data

US 2003/0199399 A1 Oct. 23, 2003

(51) Int. Cl.[7] ..... C10M 141/12

(52) U.S. Cl. ..... 508/365; 508/371; 508/372; 508/374; 508/379; 508/391; 508/445; 508/501

(58) Field of Search ..... 508/365

(56) References Cited

U.S. PATENT DOCUMENTS

| | | | | |
|---|---|---|---|---|
| 4,164,473 A | | 8/1979 | Coupland et al. | 252/32.7 E |
| 4,176,073 A | | 11/1979 | Ryer et al. | 252/32.7 E |
| 4,176,074 A | | 11/1979 | Coupland et al. | 252/32.7 E |
| 4,192,757 A | | 3/1980 | Brewster | 252/32.7 E |
| 4,201,683 A | | 5/1980 | Brewster | 252/32.7 E |
| 4,248,720 A | | 2/1981 | Coupland et al. | 252/42.7 |
| 4,289,635 A | | 9/1981 | Schroeck | 252/32.7 E |
| 4,479,883 A | | 10/1984 | Shaub et al. | 252/32.7 E |
| 4,702,850 A | * | 10/1987 | Gutierrez et al. | 508/197 |
| 6,074,993 A | * | 6/2000 | Waddoups et al. | 508/364 |
| 6,143,701 A | | 11/2000 | Boffa | |
| RE37,363 E | * | 9/2001 | Gatto et al. | 508/364 |
| 6,300,291 B1 | | 10/2001 | Hartley et al. | 508/363 |
| 6,329,328 B1 | * | 12/2001 | Koganei et al. | 508/365 |
| 6,444,624 B1 | * | 9/2002 | Walker et al. | 508/363 |
| 6,500,786 B1 | * | 12/2002 | Hartley et al. | 508/365 |

FOREIGN PATENT DOCUMENTS

| | | | |
|---|---|---|---|
| EP | 0 855 437 A1 | 7/1998 | C10M/135/18 |
| EP | 1 013 749 A2 | 6/2000 | C10M/141/08 |
| EP | 1 013 749 A3 | 1/2001 | C10M/141/08 |
| WO | WO95/07962 A1 | 3/1995 | C10M/141/06 |
| WO | WO99/60080 A1 | 11/1999 | C10M/141/10 |

* cited by examiner

*Primary Examiner*—Ellen M McAvoy

(57) ABSTRACT

A lubricating oil composition comprising a) an oil of lubricating viscosity having a viscosity index of at least 95; b) at least one calcium detergent; c) at least one oil soluble molybdenum compound; d) at least one organic ashless nitrogen-free friction modifier; and e) at least one metal dihydrocarbyldithiophosphate compound, the composition having a Noack volatility of about 15 wt. % or less, from 0.05 to 0.6 wt. % calcium from the calcium detergent, molybdenum in an amount of at least 10 ppm from the molybdenum compound, and phosphorus from the metal dihydrocarbyldithiophosphate compound in an amount up to about 0.1 wt. %.

20 Claims, No Drawings

LUBRICATING OIL COMPOSITION

The present invention relates to lubricating oil compositions. More particularly, the present invention relates to lubricating oil compositions, which exhibit simultaneously improved low temperature valve train wear performance, excellent compatibility with fluoroelastomer materials commonly used for seals in modern internal combustion engines, and improved fuel economy properties.

BACKGROUND OF THE INVENTION

Lubricating oil compositions used to lubricate internal combustion engines contain base oil of lubricating viscosity, or a mixture of such oils, and additives used to improve the performance characteristics of the oil. For example, additives are used to improve detergency, to reduce engine wear, to provide stability against heat and oxidation, to reduce oil consumption, to inhibit corrosion, to act as a dispersant, and to reduce friction loss. Some additives provide multiple benefits, such as dispersant-viscosity modifiers. Other additives, while improving one characteristic of the lubricating oil, have an adverse effect on other characteristics. Thus, to provide lubricating oil having optimal overall performance, it is necessary to characterize and understand all the effects of the various additives available, and carefully balance the additive content of the lubricant.

It has been proposed in many patents and articles (for example, U.S. Pat. Nos. 4,164,473; 4,176,073; 4,176,074; 4,192,757; 4,248,720; 4,201,683; 4,289,635; and 4,479,883) that oil-soluble molybdenum compounds are useful as lubricant additives. In particular, the addition of molybdenum compounds to oil, particularly molybdenum dithiocarbamate compounds, provides the oil with improved boundary friction characteristics and bench tests demonstrate that the coefficient of friction of oil containing such molybdenum compounds is generally lower than that of oil containing organic friction modifiers. This reduction in coefficient of friction results in improved antiwear properties and may contribute to enhanced fuel economy in gasoline or diesel fired engines, including both short- and long-term fuel economy properties (i.e., fuel economy retention properties). To provide antiwear effects, molybdenum compounds are generally added in amounts introducing from about 350 ppm up to 2,000 ppm of molybdenum into the oil. While molybdenum compounds are effective antiwear agents and may further provide fuel economy benefits, such molybdenum compounds are expensive relative to more conventional, metal-free (ashless) organic friction modifiers U.S. Pat. No. 6,300,291 discloses a lubricating oil composition having a specified Noack volatility containing a base oil of a specified viscosity index, calcium-based detergent, zinc dihydrocarbyldithiophosphate (ZDDP) antiwear agent, a molybdenum compound and a nitrogen-containing friction modifier. The molybdenum compound was used in an amount providing the formulated lubricant with up to 350 ppm of molybdenum. The claimed materials are described as providing fuel economy benefits compared to compositions containing only molybdenum compounds.

Modern internal combustion engines include numerous gaskets and other seals formed of fluoroelastomer materials, such as Viton™. Nitrogen-containing additives are suspected of, over time, contributing to the deterioration of such materials. Therefore, it would be desirable to find a lubricating oil composition that provides improved fuel economy benefit; demonstrates excellent wear protection characteristics, is relatively low in cost, and is free of nitrogen-containing friction modifiers.

It has now been found that the addition of small amounts of one or more oil soluble molybdenum compounds, in combination with an ashless, organic nitrogen-free friction modifier, ZDDP and a calcium detergent provide low cost lubricating oils having a demonstrable fuel economy benefit; excellent wear protection characteristics, and reduced adverse effects on engine seals formed of Viton™ and similar fluoroelastomers.

The present invention also provides many additional advantages that shall become apparent as described below.

SUMMARY OF THE INVENTION

In accordance with a first aspect, the invention provides a lubricating oil composition displaying excellent low temperature valve train wear performance, improved fuel economy retention properties and compatibility with fluoroelastomer-based engine seals, which composition comprises an oil of lubricating viscosity having a viscosity index (VI) of at least 95; a calcium detergent in an amount introducing from about 0.05 to about 0.6 wt. % calcium into the composition; an amount of a metal dihydrocarbyldithiophosphate compound introducing up to 0.1 wt. % (1000 ppm) of phosphorus into the composition; at least one molybdenum compound in an amount sufficient to provide the composition with at least 10 ppm of molybdenum; and an effective amount of at least one organic, nitrogen-free, ashless friction modifier; the composition having a Noack volatility of less than 15%.

In accordance with a second aspect, the invention is directed to a method of improving the fuel economy, seal life and/or the wear characteristics of an internal combustion engine, which method comprises the steps of lubricating an internal combustion engine with a lubricating oil composition of the first aspect and operating the engine.

In accordance with a third aspect, the invention is directed to the use of a lubricating oil composition of the first aspect to improve the fuel economy, seal life and/or the wear characteristics of an internal combustion engine.

Other and further objects, advantages and features of the present invention will be understood by reference to the following.

DESCRIPTION OF THE PREFERRED EMBODIMENTS

The oil of lubricating viscosity can be at least one oil selected from the group consisting of Group I, Group II, or Group III base stocks or base oil blends of the aforementioned base stocks provided that the viscosity of the base oil or base oil blend is at least 95 and allows for the formulation of a lubricating oil composition having a Noack volatility, measured by determining the evaporative loss in mass percent of an oil after 1 hour at 250° C. according to the procedure of ASTM D5880, of less than 15%. In addition, the oil of lubricating viscosity may be one or more Group IV or Group V base stocks or combinations thereof or base oil mixtures containing one or more Group IV or Group V base stocks in combination with one or more Group I, Group II and/or Group III base stocks.

The most preferred oils for fuel economy retention, are:

(a) Base oil blends of Group III base stocks with Group I or Group II base stocks, where the combination has a viscosity index of at least 110; or (b) Group III, IV or V base stocks or base oil blends of more than one Group III, IV or V base stocks, where the viscosity index is between about 120 to about 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table E-1.

b) Group II base stocks contain greater than or equal to 90 percent saturates and less than or equal to 0.03 percent sulfur and have a viscosity index greater than or equal to 80 and less than 120 using the test methods specified in Table E-1.

c) Group III base stocks contain greater than or equal to 90 percent saturates and less than or equal to 0.03 percent sulfur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

For the lubricating oil compositions of this invention, any suitable oil-soluble organo-molybdenum compound having friction modifying and/or anti-wear properties in lubricating oil compositions may be employed. As an example of such oil-soluble organo-molybdenum compounds, there may be mentioned the dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

The molybdenum compound may be mono-, di-, tri- or tetra-nuclear. Dinuclear and trinuclear molybdenum compounds are preferred. The molybdenum compound is preferably an organo-molybdenum compound. More preferably, the molybdenum compound is selected from the group consisting of molybdenum dithiocarbamates (MoDTC), molybdenum dithiophosphates, molybdenum dithiophosphinates, molybdenum xanthates, molybdenum thioxanthates, molybdenum sulfides and mixtures thereof. Most preferably, the molybdenum compound is present as a molybdenum dithiocarbamate or a trinuclear organo-molybdenum compound.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Among the molybdenum compounds useful in the compositions of this invention are organo-molybdenum compounds of the formulae $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

One class of preferred organo-molybdenum compounds useful in the lubricating compositions of this invention are trinuclear molybdenum compounds, especially those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of

1

2

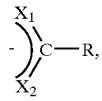

3

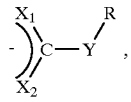

4

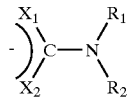

, and

5

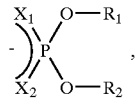

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

The term "hydrocarbyl" denotes a substituent having carbon atoms directly attached to the remainder of the ligand and is predominantly hydrocarbyl in character within the context of this invention. Such substituents include the following:

1. Hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group).

2. Substituted hydrocarbon substituents, that is, those containing non-hydrocarbon groups which, in the context of this invention, do not alter the predominantly hydrocarbyl character of the substituent. Those skilled in the art will be aware of suitable groups (e.g., halo, especially chloro and fluoro, amino, alkoxyl, mercapto, alkylmercapto, nitro, nitroso, sulfoxy, etc.).

3. Hetero substituents, that is, substituents which, while predominantly hydrocarbon in character within the context of this invention, contain atoms other than carbon present in a chain or ring otherwise composed of carbon atoms.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ to have cationic cores surrounded by anionic ligands and are represented by structures such as

6

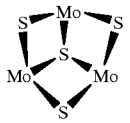

and

7

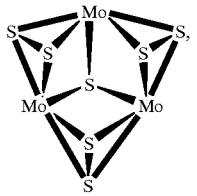

and have net charges of +4. Consequently, in order to solubilize these cores the total charge among all the ligands must be −4. Four monoanionic ligands are preferred. Without wishing to be bound by any theory, it is believed that two or more trinuclear cores may be bound or interconnected by means of one or more ligands and the ligands may be multidentate. This includes the case of a multidentate ligand having multiple connections to a single core. It is believed that oxygen and/or selenium may be substituted for sulfur in the core(s).

Oil-soluble or dispersible trinuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible trinuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. In the compounds of the present invention, at least 21 total carbon atoms should be present among all the ligands' organo groups. Preferably, the ligand source chosen has a sufficient number of carbon atoms in its organo groups to render the compound soluble or dispersible in the lubricating composition.

The terms "oil-soluble" or "dispersible" used herein do not necessarily indicate that the compounds or additives are soluble, dissolvable, miscible, or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricating compositions of the present invention contain the molybdenum compound in an amount providing the composition with at least 10 ppm of molybdenum. An amount of at least 10 ppm of molybdenum from a molybdenum compound has been found to be effective to provide a fuel economy benefit in combination with an ashless, organic nitrogen-free friction modifier. Preferably, the molybdenum from a molybdenum compound is present in an amount of from about 10 ppm to about 750 ppm, such as 10 ppm to 350 ppm, more preferably from about 30 ppm to 200 ppm, still more preferably in an amount of from about 50 ppm to about 100 ppm, based on the total weight of the lubricating composition. Because such molybdenum compounds also provide antiwear credits to lubricating oil compositions, the use thereof allows for a reduction in the amount of metal dihydrocarbyl dithiophosphate antiwear agent (e.g., ZDDP) employed. Industry trends are leading to a reduction in the amount of ZDDP being added to lubricating oils to reduce the phosphorous content of the oil to below 1000 ppm, such as to 250 ppm to 750 ppm, or 250 ppm to 500 ppm. To provide adequate wear protection in such low phosphorous lubricating oil compositions, the molybdenum compound should be present in an amount providing at least 50 ppm by mass of molybdenum. The amount of molybdenum and/or zinc may be determined by Inductively Coupled Plasma (ICP) emission spectroscopy using the method described in ASTM D5185.

Organic, ashless (metal-free), nitrogen-free organic friction modifiers useful in the lubricating oil compositions of the present invention are known generally and include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26.

The organic friction modifier is included in the lubricating oil compositions of the present invention in an amount effective to allow the composition to reliably pass a Sequence VIB fuel economy test in combination with the molybdenum compound. For example, the organic ashless nitrogen-free friction modifier may be added to the molybdenum-containing lubricating oil composition in an amount sufficient to obtain a retained fuel economy improvement of at least 1.7% for an SAE 5W-20 lubricant, 1.1% for a 5W-30 lubricant, and 0.6% for a 10W-30 lubricant as measured at 96 hours (Phase II performance) in the ASTM Sequence VIB Fuel Economy Test. Typically, to provide the desired effect, the organic ashless nitrogen-free friction modifier is added in an amount of from about 0.25 wt. % to about 2.0 wt. % (AI), based on the total weight of the lubricating oil composition. Preferred organic ashless nitrogen-free friction modifiers are esters; a particularly preferred organic ashless nitrogen-free friction modifier is glycerol monooleate (GMO).

Ashless aminic friction modifiers excluded from compositions of the present invention include oil-soluble alkoxylated mono- and di-amines, which improve boundary layer lubrication, but may contribute to the deterioration over time of fluoroelastomer seal materials. One common class of such metal free, nitrogen-containing friction modifier comprises ethoxylated amines. These amines are also excluded when in the form of an adduct or reaction product with a boron compound such as a boric oxide, boron halide, metaborate, boric acid or a mono-, di- or tri-alkyl borate.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Known detergents include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

In the present invention, one or more calcium-based detergents are used in an amount introducing from about 0.05 to about 0.6 wt. % calcium into the composition. The amount of calcium may be determined by Inductively Coupled Plasma (ICP) emission spectroscopy using the method described in ASTM D5185. Preferably, the calcium-based detergent is overbased and the total base number of the overbased calcium based detergent is between about 150 to 450. More preferably, the calcium-based detergent is an overbased calcium sulfonate detergent. The compositions of the present invention may further include either neutral or overbased magnesium-based detergents, however, preferably, the lubricating oil compositions of the present invention will be magnesium free.

Metal dihydrocarbyl dithiophosphate antiwear agents that may be added to the lubricating oil composition of the present invention comprise dihydrocarbyl dithiophosphate metal salts wherein the metal may be an alkali or alkaline earth metal, or aluminum, lead, tin, molybdenum, manganese, nickel, copper or preferably, zinc. The zinc salts are most commonly used in lubricating oil.

Dihydrocarbyl dithiophosphate metal salts may be prepared in accordance with known techniques by first forming a dihydrocarbyl dithiophosphoric acid (DDPA), usually by reaction of one or more alcohol or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil soluble salts of dihydrocarbyl dithiophosphoric acids and may be represented by the following formula:

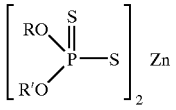

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

To limit the amount of phosphorus introduced into the lubricating oil composition by ZDDP to no more than 0.1 wt. % (1000 ppm), the ZDDP should preferably be added to the lubricating oil compositions in amounts no greater than from about 1.1 to 1.3 wt. %, based upon the total weight of the lubricating oil composition.

Other additives, such as the following, may also be present in lubricating oil compositions of the present invention.

Ashless dispersants comprise an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersants may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Viscosity modifiers (VM) function to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorus esters, metal thiocarbamates and oil soluble copper compounds as described in U.S. Pat. No. 4,867,890.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass %, preferably 4 to 18 mass %, and most preferably about 5 to 17 mass % of the concentrate or additive package with the remainder being base stock.

EXAMPLES

Example 1

Seal Performance 5W-30 grade lubricating oil compositions were formulated using substantially identical amounts of Group II base oil (viscosity index of 118), viscosity modifier, pour point depressant, dispersant, antioxidant, emulsifier and defoamer, and amounts of ZDDP, molybdenum compound (molybdenum dithiocarbamate), overbased calcium sulfonate detergent (300 TBN) and organic nitrogen-containing friction modifier (ethoxylated tallow amine or ETA) and organic ashless nitrogen-free friction modifier (glycerol monooleate or GMO), as shown in the Table 1.

TABLE 1

| | Oil 1 | Oil 2 | Oil 3 (Inv.) | Oil 4 |
|---|---|---|---|---|
| Calcium Sulfonate Detergent | 1.6 | 1.6 | 1.6 | 1.6 |
| Molybdenum Compound | | 0.3 | 0.3 | 0.3 |
| ZDDP | 1.2 | 1.2 | 1.2 | 1.2 |
| GMO | | | 1 | |
| ETA | | | | 1 |

TABLE 1-continued

| | Oil 1 | Oil 2 | Oil 3 (Inv.) | Oil 4 |
|---|---|---|---|---|
| Phosphorus, mass % | 0.09 | 0.09 | 0.09 | 0.09 |
| Calcium, mass % | 0.19 | 0.19 | 0.19 | 0.19 |
| Molybdenum, ppm | 0 | 160 | 160 | 160 |
| KV100 | 10.3 | 10.3 | 10.3 | 10.3 |
| CCS −30 | 3150 | 3140 | 3250 | 3270 |
| CCS −35 | 6280 | 6510 | 6560 | 6565 |
| Noack | 14 | 13.5 | 13.8 | 13.9 |

The above formulations were evaluated for performance in a Volkswagen Viton seal test using method VW PV 3344. The pass/fail criteria are decrease in tensile strength, elongation at break, and the presence or absence of cracking. The results of the evaluation are shown in Table 2.

TABLE 2

| VW seals (AK-6) | Oil 1 | Oil 2 | Oil 3(Inv.) | Oil 4 |
|---|---|---|---|---|
| Tensile Strength, Mpa | 10.7 | 9.6 | 9.1 | 4.2(F)* |
| Elongation at break, % | 248 | 219 | 208 | 108(F)* |
| Crack Assessment | No cracks | No cracks | No cracks | Cracks(F)* |
| | New seal | | | |
| Tensile Strength, Mpa | 15.4 | | | |
| Elongation at break, % | 322 | | | |
| Crack Assessment | No cracks | | | |

*(F) indicates "fail"

The results of Table 2 show quite clearly that the nitrogen containing friction modifier (ETA) has a negative impact on seal performance for all rated criteria.

GMO has no effect on seal performance.

Example 2

Fuel Economy 0W-20 grade lubricating oil compositions were formulated using substantially identical amounts of Group II base oil (viscosity index of 118), viscosity modifier, pour point depressant, dispersant, antioxidant, emulsifier and defoamer, and amounts of ZDDP, molybdenum compound (molybdenum dithiocarbamate), overbased calcium sulfonate detergent (300 TBN) and organic ashless nitrogen-free friction modifier (glycerol monooleate or GMA), as shown in the Table 3. For comparison with a baseline, Oil 10 contained a comparable base oil with no additive.

TABLE 3

| | Oil 5 | Oil 6 | Oil 7 (Inv.) | Oil 8 | Oil 9 | Oil 10 |
|---|---|---|---|---|---|---|
| Calcium Sulfonate Det. | 1.6 | 1.6 | 1.6 | 1.6 | 1.6 | |
| Molybdenum Compound | | 0.3 | 0.3 | 1.5 | 0.3 | |
| ZDDP | 1.2 | 1.2 | 1.2 | 1.2 | 0.6 | |
| GMO | | | 1 | | 1 | |
| Noack | 12.6 | 12.4 | 13.1 | 13.3 | 12.8 | 13.7 |
| KV100 | 8.9 | 8.9 | 8.8 | 8.9 | 8.7 | 4.7 |
| CCS −30 | 2750 | 2760 | 2790 | 2790 | 2710 | N/A |
| CCS −35 | 5560 | 5560 | 5650 | 5640 | 5580 | N/A |
| KV −40 | | | | | | 25.13 |
| Viscosity Index | | | | | | 102 |
| Phosphorus, mass % | 0.09 | 0.09 | 0.09 | 0.09 | 0.045 | |
| Calcium, mass % | 0.19 | 0.19 | 0.19 | 0.19 | 0.19 | |
| Molybdenum, ppm | 0 | 170 | 170 | 820 | 170 | |

Oils 5 through 9 were tested in the Sequence VIB screener test to measure differences in fuel economy performance. The Sequence VIB screener is used to predict fuel economy performance in the full length ASTM Sequence VIB test.

In the Sequence VIB screener test, the fuel consumption of the engine with a base line calibration oil is determined. A flying flush to the candidate oil is carried out and the oil is aged for 16 hours before measuring the fuel consumption of the engine with the candidate. Up to this point, the procedure is identical to the ASTM Sequence VIB test. In the screener, fuel economy improvement is measured for stages 1, 2, and 4 whereas stages 1 through 5 are measured in the full-length test. After the first candidate, a double detergent flush is carried out and a flying flush is made to the next candidate oil. The procedure continues as described until the final candidate is evaluated and then the performance of the base line calibration oil is made a second time. Results are reported as fuel economy improvement relative to the base line calibration oil (Oil 10).

Stage 1 in the Sequence VIB screener measures improvement in boundary friction. In this stage of the test, compounds that lower friction are expected to give strong response. Molybdenum dithiocarbamate is known to lower boundary friction and bench friction rigs (high frequency reciprocating rig, or HFRR) show that the coefficient of friction of oils containing molybdenum dithiocarbamate are in general much lower than oils containing organic friction modifiers. Therefore, it would be expected that the combination of a low level of molybdenum dithiocarbamate with organic friction modifiers would provide inferior fuel economy performance under boundary conditions compared with an otherwise identical oil containing a high level of molybdenum dithiocarbamate.

TABLE 4

(Sequence VIB Screener Results)
Weighted Responses - % Fuel Economy Improvement versus base line calibration oil

| | Oil 5 | Oil 6 | Oil 7 (Inv.) | Oil 8 | Oil 9 (Inv.) | Oil 10 |
|---|---|---|---|---|---|---|
| Stage 1 Improvement | −0.596 | −0.048 | 0.113 | 0.096 | 0.262 | N/A |

Oil 5 had neither molybdenum nor organic friction modifier. Oil 6 was identical to Oil 5 except it had 170 ppm Mo from molybdenum dithiocarbamate. With no friction modifier (Oil 5), Stage 1 is negative (worse than) versus the base line calibration oil. Adding molybdenum (Oil 6) improved the stage 1 performance but the fuel economy improvement remained negative versus the base line calibration oil.

Since molybdenum dithiocarbamate is more potent than organic friction modifiers in the HFRR (see Table 5) it would be expected that the oil with the highest level of molybdenum would have the best performance. However, Oil 7 with the combination of molybdenum at 170 ppm and an organic friction modifier at 1.0 mass % showed an improvement in fuel economy compared to Oil 8, which had 820 ppm molybdenum. Optimal fuel economy was reached with 170 ppm Mo, 1 mass % glycerol monooleate, and 500 ppm phosphorus from zinc dialkyl dithiophosphate (Oil 9).

TABLE 5

| | (HFRR Data) | | | | |
|---|---|---|---|---|---|
| Temp., ° C. | Oil 5 | Oil 6 | Oil 7 (Inv.) | Oil 8 | Oil 9 (Inv.) |
| | Coefficient of Friction | | | | |
| 40 | 0.166 | 0.163 | 0.154 | 0.163 | 0.15 |
| 60 | 0.168 | 0.165 | 0.143 | 0.151 | 0.141 |
| 80 | 0.18 | 0.164 | 0.134 | 0.113 | 0.133 |
| 100 | 0.18 | 0.124 | 0.128 | 0.086 | 0.125 |
| 120 | 0.174 | 0.097 | 0.123 | 0.081 | 0.121 |
| 140 | 0.17 | 0.089 | 0.119 | 0.075 | 0.118 |

Table 5 provides HFRR results for Oils 5 through 9. As discussed supra, HFRR results suggest that lubricants containing molybdenum show a decrease in coefficient of friction, especially at 80 and 100° C. The combination of molybdenum and organic friction modifier was worse than molybdenum alone at 170 or 820 ppm Mo. There is no difference between high and low levels of molybdenum with organic friction modifier with amounts of ZDDP providing 500 and 1000 ppm of P. This data establish that the results of the Sequence VIB screener summarized in Table 4 would not be expected.

The subject matter of all patents, articles, test specifications and other references described above is hereby incorporated into this specification in its entirety. While several specific embodiments in accordance with the invention have been illustrated and described, it is to be clearly understood that the same are susceptible to numerous changes apparent to one skilled in the art. Therefore, the invention should not be considered limited to the details shown and described and instead includes all changes and modifications which come within the scope of the appended claims.

What is claimed is:

1. A lubricating oil composition comprising:

a) an oil of lubricating viscosity having a viscosity index of at least 95;

b) at least one calcium detergent;

c) at least one oil soluble molybdenum compound;

d) at least one organic ashless nitrogen-free friction modifier; and e) at least one metal dihydrocarbyl dithiophosphate compound, wherein said composition is substantially free of ashless aminic friction modifiers, has a Noack volatility of about 15 wt. % or less, from about 0.05 to 0.6 wt. % calcium from the calcium detergent, molybdenum in an amount of from about 10 ppm to about 350 ppm from the molybdenum compound, and phosphorus from the metal dihydrocarbyl dithiophosphate compound in an amount up to about 0.1 wt. %.

2. The composition according to claim 1, wherein said calcium detergent is selected from the group consisting of calcium phenates, calcium salicylates, calcium sulfonates, and mixtures thereof.

3. The composition according to claim 1, wherein said calcium detergent is an overbased calcium sulfonate.

4. The composition according to claim 3, wherein said overbased calcium sulfonate has a total base number of between about 150 to 450.

5. The composition according to claim 1, wherein said molybdenum from a molybdenum compound is present in an amount of about 30 ppm to 200 ppm.

6. The composition according to claim 1, wherein said molybdenum compound is an organo-molybdenum compound.

7. The composition according to claim 6, wherein said molybdenum compound is selected from the group consisting of: a molybdenum dialkyldithiocarbamate, molybdenum dialkyldithiophosphate, molybdenum dialkyldithiophosphinate, molybdenum xanthate, molybdenum thioxanthate, and mixtures thereof.

8. The composition according to claim 7, wherein said molybdenum compound is present as molybdenum dialkyldithiocarbamate.

9. The composition according to claim 8, wherein said molybdenum compound is a trinuclear molybdenum compound.

10. The composition according to claim 1 wherein said molybdenum compound is a molybdenum/sulfur complex of a basic nitrogen compound.

11. The composition according to claim 1, wherein said at least one metal dihydrocarbyl dithiophosphate compound comprises at least one zinc dihydrocarbyl dithiophosphate compound.

12. The composition according to claim 1, wherein said organic ashless nitrogen-free friction modifier is present in an amount of from about 0.25 wt. % to about 2.0 wt. %, based on the total weight of the composition.

13. The composition according to claim 1, wherein said at least one organic ashless nitrogen-free friction modifier is an ester.

14. The composition according to claim 13, wherein said ester is glycerol monooleate.

15. The composition according to claim 1, wherein said composition contains from about 0.025 wt. % to about 0.1 wt. % phosphorus from the metal dihydrocarbyl dithiophosphate compound.

16. The composition according to claim 15, wherein said composition contains from about 0.025 wt. % to 0.075 wt. % phosphorus from the metal dihydrocarbyl dithiophosphate compound.

17. The composition according to claim 16, wherein said composition contains from about 0.025 wt. % to 0.05 wt. % phosphorus from the metal dihydrocarbyl dithiophosphate compound.

18. A method for improving the fuel economy and fuel economy retention properties of an internal combustion engine, which comprises: (1) adding to said engine the lubricating oil composition of claim 1; and (2) operating said engine.

19. A method for improving the anti-wear protection of an internal combustion engine comprising the steps of: (1) adding a lubricating oil composition of claim 1; and (2) operating the engine.

20. A method for improving the compatibility between a lubricating oil composition and the seals of an internal combustion engine comprising the steps of: (1) adding to said engine a lubricating oil composition of claim 1; and (2) operating the engine.

* * * * *